United States Patent [19]

Fukuda et al.

[11] Patent Number: 4,767,475

[45] Date of Patent: Aug. 30, 1988

[54] WEAR RESISTANT RAILS HAVING CAPABILITY OF PREVENTING PROPAGATION OF UNSTABLE RUPTURE

[75] Inventors: Kozo Fukuda; Tsunemi Wada; Shinichi Nagahashi; Yoshio Saito; Masahiro Ueda; Minoru Tanaka, all of Tokyo, Japan

[73] Assignee: Nippon Kokan Kabushiki Kaisha, Tokyo, Japan

[21] Appl. No.: 919,059

[22] Filed: Oct. 15, 1986

[30] Foreign Application Priority Data

Oct. 24, 1985 [JP] Japan ..... 60-236383

[51] Int. Cl.[4] ..... C22C 38/02; C22C 38/04

[52] U.S. Cl. ..... 148/33; 148/334; 148/335; 148/336; 148/320; 148/902; 238/150

[58] Field of Search ..... 148/902, 12 B, 333, 148/334, 335, 336, 320; 238/122, 150; 428/591, 603

[56] References Cited

U.S. PATENT DOCUMENTS 4,575,397 3/1986 Heller ..... 148/902

FOREIGN PATENT DOCUMENTS 3336006 4/1985 Fed. Rep. of Germany .
103154 6/1985 Japan .

*Primary Examiner*—Deborah Yee
*Attorney, Agent, or Firm*—Frishauf, Holtz, Goodman & Woodward

[57] ABSTRACT

A wear resistance rail which comprises 0.50 to 0.85 wt. % of C, 0.10 to 1.0 wt. % of Si, 0.50 to 1.50 wt. % of Mn, less than 0.035 wt. % of P, less than 0.035 wt. % of S, less than 0.050 wt. % of Al, and the balance of iron and impurities. The web has a high toughness tempered bainite structure, tempered martensite structure or a tempered mixed structure of bainite and martensite and the head rail has high wear resistance which prevents unstable destructive cracks from propagating. The rail can further contain one or more of 0.05 to 1.50 wt. % of Cr, 0.05 to 0.20 wt. % of Mo, 0.03 to 0.10 wt. % of V, 0.10 to 1.00 wt. % of Ni, and 0.005 to 0.050 wt. % of Nb.

16 Claims, 2 Drawing Sheets

WEAR RESISTANT RAILS HAVING CAPABILITY OF PREVENTING PROPAGATION OF UNSTABLE RUPTURE

BACKGROUND OF THE INVENTION

This invention relates to a wear resistant high strength rail utilized at a curved portion of a rail road, and more particularly a wear resistant high quality rail having a capability of preventing propagation of unstable rupture.

Rupture of a rail often results in a large train accident. Among the causes of the rupture include a shelling damage caused by the contact between the rail and a car wheel, cracks at the joints between rails, shatter cracks in the rail, large oxide contaminants and deep surface defects. When the rail is used over a long period of time, various cracks occur at various portions of the rail which result in transversal or longitudinal defects due to fatigue, and will propagate with time. Eventually, the defect reaches a specific rupture toughness value (for example $K_{IC}$ value specified by ASTM E399). As a consequence, a rapid unstable rupture occurs, thus breaking the rail. In a derail accident causing a large number of victims, when the end of a wear resistant alloy steel rail including cracks produced at the time of cutting with gas was examined. It was found that unstable rupture cracks induced by a shock load caused by the car wheel propagate over a length of more than 10 meters in the longitudinal direction in the web 11 of a rail 10 as shown in FIG. 5. Such cracks branch to the head 12 or foot 13, thus resulting in an accidental rupture.

In a prior art wear resistant rail utilized to prevent these defects, the wear resistance property of its head 12 contacting with the car wheel is constructed to have a fine pearlite structure having a higher strength than an ordinary rail.

Although such fine pearlite structure provides excellent wear resistant property, it is brittle so that its resistance to the generation of unstable rupture is low. For this reason, when using such a rail, it is necessary to always prevent the generation of surface and inside defects. Where there is a fear of generating such defects, it is necessary to periodically detect such defects by ultrasonic fault locater before the unstable rupture occurs so as to detect and remove defective portions.

Various measures have been tried to increase the resistance to generation of unstable rupture caused by fatigue and defects generated at specific portions of the rail such as, the web and the foot. These measures, however, are not always effective. In any case, it is necessary to always avoid the generation of defects and the propagation of unstable destructive cracks. Yet, such generation of defects and propagation thereof has not been avoidable in existing rails.

SUMMARY OF THE INVENTION

Accordingly, it is an object of this invention to provide a wear resistant rail having a capability of preventing propagation of unstable cracks.

More specific object of this invention is to provide a steel rail having a fine pearlite structure capable of manifesting a high wear resistant property and a high strength which can be used at a curved portion of a railway road.

Another object of this invention is to provide a rail capable of preventing propagation of unstable cracks to the head and web portions of the rail, thus preventing large accident.

According to this invention, there is provided wear resistant rail containing 0.50 to 0.85 wt% of C, 0.10 to 1.0 wt% of Si, 0.50 to 1.50 wt% of Mn, less than 0.035 wt% of P, less than 0.035 wt% of S, 0.050 wt% of Al and balance of iron and impurities, with the web of the rail having a tempered bainite structure and a high toughness, and a head of the rail having a fine pearlite structure of high strength.

By containing C of higher than 0.5 wt%, the wear resistant property can be provided. When the content of Si is increased more than 0.10 wt%, and when Mn is increased to more than 0.50 wt%, the strength can be improved. When the content of C is selected to be less than 0.85 wt% and when the content of Si is selected to be less than 1.00 wt% decrease in the ductility can be prevented. When the content of P and S is selected to be no more than 0.035 wt% respectively, degradation of the ductility and toughness can be prevented. When the content of Mn is selected to be less than 1.50 wt%, degradation of the weldability can be avoided. Furthermore, where Al is selected to be less than 0.050 wt%, degradation of the fatigue resistant property can be prevented.

Where the web has a high toughness tempered bainite structure or martensite structure or a mixed tempered bainite-martensite structure, propagation of the unstable rupture can be effectively prevented. Furthermore, by causing the head to have a fine pearlite structure of high strength, the wear resistant property of the rail can be increased.

BRIEF DESCRIPTION OF THE DRAWINGS

In the accompanying drawings.

DESCRIPTION OF THE PREFERRED EMBODIMENTS

Figure 1:
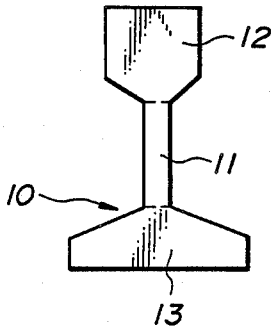
FIG. 1 is a cross-sectional view of a rail.

It has been found that a transversal crack in the head or a horizontal crack in the web caused by fatigue propagates to cause a large failure. Especially a crack created in the web which propagates in the longitudinal direction and branchs to the head and foot of the rail and causes a large failure, such as a break off of the head. Consequently, it is important to provide a capability to the web that arrest a high speed propagation of an unstable destructive crack. We have made many studies for imparting to the web a capability of arresting the high speed propagation of unstable destructive cracks by studying the composition and structure of the rail steel and have found that a metal structure consisting essentially of tempered bainite structure, tempered martensite structure and a mixture thereof can manifest excellent capability. We found that these structures are superior to the pearlite structure or tempered pearlite structure previously utilized for the web of the wear resistant rail. We have prepared test rails, the heads thereof composing of fine pearlite structure having a high strength and the webs thereof composed of tempered bainite structure, tempered martensite structure or a mixed tempered martensite-bainite structure and subjected the test rails to fracture tests. The result of tests showed that these test rails have greatly improved the capability of arresting propagation of unstable destructive cracks, thus preventing breakage or fracture of the rails.

The chemical composition of the rail was limited for the following reasons.

C is an indispensable element for imparting a wear resistant property. With less than 0.50 wt% of C (hereinafter merely designated by %) wear is severe so that it is impossible to obtain practical wear resistant steel. On the otherhand, with C of higher than 0.85%, pro-eutectoid cementite is formed in the metal structure, thereby degrading the ductility. For this reason the range of C was limited between 0.50% and 0.85%.

Si is used for the purpose of deoxidation and for improving the strength. Thus, for killed steel at least 0.10% of Si is necessary as a deoxidation element. Although the strength can be improved with a larger quantity of Si, addition of Si by more than 1.00% decreases the ductility. For this reason 1.00% is the upper limit.

Mn is indispensable for improving the strength. With less than 0.50%, its effect of improving the strength is small, whereas more than 1.50% of Mn greatly degrades the weldability. For this reason, the range of Mn was limited to be 0.50% to 1.50%.

P and S are impurity elements and when their content exceeds 0.035%, both ductility and toughness degrade. For this reason, the upper limit of each of P and S is 0.035%. Al is used in combination with Si to act as a deoxidation element. With more than 0.050% of Al, not only a large quantity of $Al_2O_3$ is formed but also fatigue characteristic degrades, so that 0.050% is the upper limit of Al. The combination described above is essential for the rail of this invention, and the elements described above are important for forming fine pearlite structure of high strength in the head of the rail. Furthermore, these elements are necessary to ensure a minimum hardenability of the web.

It is necessary, one or more of the following elements are incorporated to steel for the purpose of more effectively manufacturing the rail of this invention.

Cr: 0.05 to 1.50%
V: 0.03 to 0.10%
Nb: 0.005 to 0.050%
Mo: 0.05 to 0.20%
Ni: 0.10 to 1.00%

These percentages were selected for the following reasons;

More particularly, Cr improves the hardenability, thus making is ready to form the head as fine pearlite structure. Moreover Cr increases the resistance to softening of the pearlite structure at the time of tempering, thus making it easy to obtain a fine pearlite structure of high strength. Where the web is composed of bainite or martensite structure, the improvement of the hardenability is effective to suppress admixture of the pearlite structure necessary for transferring a pearlite nose to a long time side. Accordingly, 0.05% is the lower limit necessary to improve the hardenability, and 1.50% is selected as the upper limit because Cr at higher than 1.5% degrades the weldability. For this reason, the range of Cr was limited to be 0.05 to 1.50%.

In the same manner as Cr, Mo increases the hardenability and the strength because Mo increases the resistance to softening due to heat tempering of the pearlite structure. Thus, the range of Mo is limited for the same reason as for Cr. In other words, 0.05% is necessary as the lower limit for improving the hardenability while 0.20% is limited at the upper limit in view of the weldability.

V and Nb not only improve the hardenability but also manifest precipitation hardening, thereby increasing the strength. As the minimum quantities necessary for manifesting precipitation hardening, 0.03% of V and 0.005% of Nb are necessary. The upper limits of V and Nb are the quantities at which the effects of V and Nb saturate, that is V: 0.10% and Nb: 0.05%.

Ni is effective to improve the hardenability and to increase the hardness and toughness. With less than 0.10% of Ni, the hardenability is small while with higher than 1.00% of Ni, its effect saturates. For this reason, the range of Ni was selected to be from 0.10% to 1.00%.

The rail steel having the chemical composition described above was heat treated under the following conditions for the purpose of obtaining metal structures characterizing the invention.

More particularly, rolling heat is used, or if desired, a heat preserving furnace is provided or after rolling and cooling the rail it is reheated to a temperature higher than $AC_3$ point. The portion of the rail at a temperature higher than the $AC_3$ point is cooled. Thus the head of the rail is subjected to a slack quenching to form fine pearlite structure having a high strength. The web is rapidly quenched to cool the shorter time side than the pearlite nose and the cooling condition is changed for obtaining a desired metal structure. To obtain the bainite structure, the rail is maintained at a constant temperature between a temperature higher than Ms point and a temperature lower than $B_s$ point (upper limit temperature necessary for forming the bainite structure) for sufficiently proceeding transformation. To obtain the martensite structure, the rail is cooled to a temperature near room temperature at any cooling speed. If desired, marquenching process can be used. To obtain mixed structure of bainite and martensite, suitably quantity of martensite is formed by cooling the rail at a temperature lower than Ms point and a desired quantity of bainite is formed by heating the rail at a temperature higher than Ms point but lower than Bs point. Since the quantity of martensite formed depends upon the transformation temperature then a quantity of martensite is controlled by under-transformation cooling rate from Ms point first. It is possible to control the quantity of bainite firstly by means of changing the holding time at a transformation temperature.

The web having bainite structure, martensite structure or mixture of bainite and martensite which are formed as above described is subjected to a heat treatment followed by continuous tempering. Alternatively, the web is cooled to room temperature and then tempered to obtain a metal structure of high toughness.

When the web is heat treated, the joint region between the web and the foot would have a structure similar to that of the web and it is inevitable to contain less than 30% of pearlite structure in these structure described above. Even when the head and web are heat treated simultaneously or independently, desired metal structures can be obtained. Although there is no limit on the structure of the foot, it is advantageous that the web and the foot have the same structure, usually pearlite structure.

The method of preparing the rail of this invention can be applied to the rail of an ordinary web where a metal structure of high toughness is desired.

The following Table I illustrates the chemical composition of steel utilized in this invention.

TABLE I

| Steel Species | Type | C | Si | Mn | P | S | Al | Others | |
|---|---|---|---|---|---|---|---|---|---|
| A | Si—Mn | 0.75 | 0.27 | 0.89 | 0.017 | 0.010 | 0.007 | — | — |
| B | Si—Cr—V | 0.78 | 0.51 | 0.83 | 0.020 | 0.008 | 0.003 | 0.43 (Cr) | 0.05 (V) |
| C | Cr—Mo | 0.70 | 0.25 | 1.01 | 0.013 | 0.005 | 0.020 | 0.60 (Cr) | 0.10 (Mo) |
| D | Ni—Nb | 0.65 | 0.24 | 1.10 | 0.010 | 0.011 | 0.010 | 0.52 (Ni) | 0.019 (Nb) |

Steel A is manufactured by the following methods 1-3.

1. The rail of this invention wherein the head has a fine pearlite structure of high strength and the web has tempered bainite structure is manufactured as follows. The head is cooled to a temperature lower than 500° C. from a temperature higher than $Ac_3$ point at a rate of 2°-10° C./sec. At the same time the web is quenched at a rate higher than 15° C./sec, and held at a constant temperature between 300° to 450° C. When at least 50% has transformed into bainite, the web is reheated to 600°-700° C. at a heating rate of more than 1° C./sec. After tempering the web is cooled. The foot is cooled naturally.

2. A rail of this invention having a head composed of fine pearlite structure and a web composed of tempered martensite structure is manufactured as follows. The head is cooled to a temperature lower than 500° C. from a temperature higher than $Ac_3$ point at a rate of 2°-10° C./sec. At the same time the web is cooled to a temperature below Ms point (240° C.), that is a temperature (below 200° C.) at which more than 50% is transformed into martensite structure. If desired, at a temperature immediately above Ms point, the cooling is switched to weak cooling for effecting marquenching. After that, the web is continuously heated to 600°-700° C. at a rate of more than 1° C./sec, tempered and cooled. The foot is cooled naturally.

3. A rail of this invention having a head composed of a fine pearlite structure and a web composed of tempered mixture of bainite and martensite structures is manufactured as follows. Thus, the head is cooled to a temperature below 500° C. from a temperature higher than $Ac_3$ point at a rate of 2°-10° C./sec. At the same time, the web is quenched at a rate of higher than 15° C./sec and then held at a constant temperature of between 250° C. and 450° C. When more than 30% has been transformed into the bainite structure, the web is cooled to a temperature below Ms point, thus effecting martensite transformation. Alternatively, the web may be quenched to a temperature (200°-100° C.) at which more than 30% transformed into the martensite structure and thereafter the web is continuously heated to 300°-450° C. and held at this temperature for effecting bainite transformation. After forming a mixture of bainite and martensite, the web is continuously heated to 600°-700° C., to effect tempering and then cooled. The bottom is cooled naturally.

Where Cr, Mo, V, Ni, and Nb are incorporated as in the steel species B-D shown in Table I, due to the improvement of the hardenability it becomes possible to decrease the cooling rate of slack quenching the head and of quenching the web. In addition, the strength can be increased as above described.

After heat treating a rail having a cross-sectional configuration of 136RE by the methods similar to the methods 1 to 3 of steel A, the unstable destructive crack propagation arresting capability of the rail was evaluated according to the following methods (i) and (ii).

The testing methods employed in evaluating the rail of the invention will be described in conjunction with the drawing in which:

FIG. 1 depicts the transverse cross-section of a railway rail 10 having a web 11, a head 12 and a foot 13.

Figure 2:
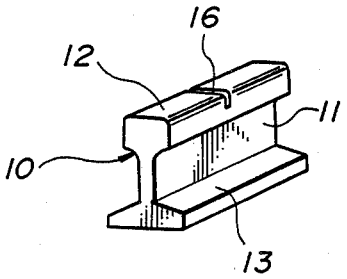
FIG. 2 is a perspective view showing a bending test piece of a rail formed with a slit.

FIG. 2 depicts a perspective view of a bend test specimen 1.5 meters long of railway rail 10 having head 12, web 11 and foot 13 with a saw slit 16 30 mm in depth and with a width of 3 mm.

Figure 3:
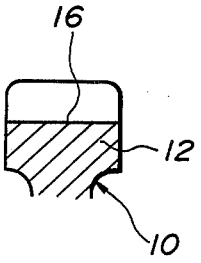
FIG. 3 is a partial sectional view of the rail along the slit.

FIG. 3 depicts an enlarged transverse view of saw slit 16 in head 12 of rail 10.

Figure 4:
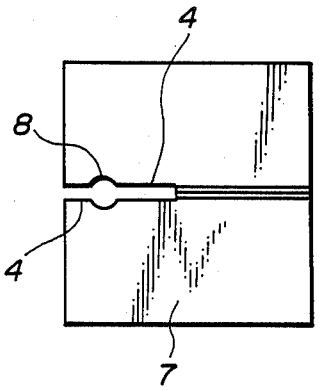
FIG. 4 is a side view of the web showing horizontal breakage test piece.

FIG. 4 depicts a horizontal view of web breakage test specimen 7 having a hole 8 and 10 mm slit 4.

Figure 5:
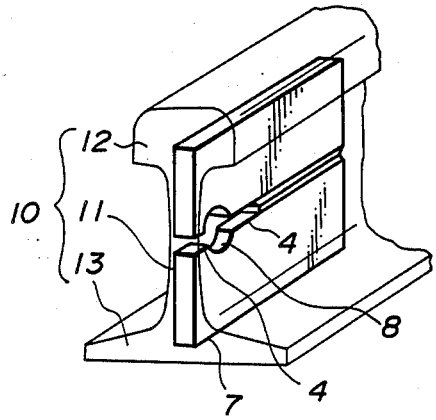
FIG. 5 is a perspective view of a rail showing a portion from which the test piece was taken.
Figure 6:
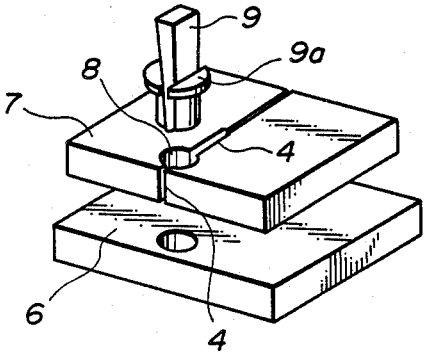
FIG. 6 is a perspective view showing the manner of testing the horizontal breakage of the web.

FIG. 5 depicts the relation of test specimen 4 to web 11 of rail 10, and FIG. 6 shows the testing condition for test piece 7 wherein test piece 7 is mounted on base plate 6 and a split pin 9*a* is expanded within hole 8 by wedge 9.

(i) Method of bending test of a rail formed with a slit.

By using a saw a slit 16 having a depth of 30 mm and a width of 3 mm was formed across the head 12 of a rail as shown in FIGS. 2 and 3. The length of the rails is 1.5 m. Then the rail was mounted on supports spaced by 1000 mm with the head 12 faced downwardly, and the slit 16 positioned at the center between the supports. Then a static bending force is applied to the rail to generate and propagate unstable destructive crack at the slit 16. The propagation arresting performance is judged whether the rail breaks or not and the rail not broken was judged as having the propagation arresting performance.

(ii) Method of web horizontal breakage test.

For the purpose of evaluating the arresting performance of the horizontal crack of the rail web a test piece 7 as shown in FIG. 4 was cut out from a portion shown in FIG. 5. The test was made according to ASTM test method for crack arrest fracture toughness to obtain a $K_a$ value. This testing condition is shown in FIG. 6. Thus the test piece 7 is mounted on a base plate 6 and a wedge 9 including a split pin 9*a* was driven into an opening 8 of the test piece 7.

The test piece 7 has a thickness of 16 mm, a width of 128 mm, the width of slit 4 communicated with the opening 8 of 10 mm, the length of the slit 4 from the opening 8 of 45 mm and the diameter of opening 8 of 25.5 mm.

When the value of $K_a$ value determined by the web horizontal breakage test, (crack arresting toughness value) is higher than 200 kg/mm$^{3/2}$ it is judged that the test piece has the unstable destructive crack propagation arresting performance.

The test results of the rails of this invention and prior technique are shown in the following Table II which shows that the rails of this invention has much higher unstable crack propagation arresting performance than the prior technique of wear resistant rails.

TABLE II

| Steel Species | Rail's Type | Head: Metal Structure | Head: TS (Kgf/mm$^2$) | Web and Foot: Metal Structure | Web and Foot: TS (Kgf/mm$^2$) | Unstable Destructive Crack Propagation Arresting Performance of Web: Bending Test With Slit | Unstable Destructive Crack Propagation Arresting Performance of Web: Web Horizontal Breakage Test (Ka, Kg/mm$^{3/2}$) |
|---|---|---|---|---|---|---|---|
| A | Control | f · p | 131.3 | p | 95.3 | No | No (112) |
| A | This Invention | f · p | 133.2 | T · B | 99.8 | Yes | Yes (279) |
| A | This Invention | f · p | 126.7 | T · M | 109.4 | Yes | Yes (271) |
| A | This Invention | f · p | 130.5 | T · BM | 101.5 | Yes | Yes (269) |
| B | Control | f · p | 131.3 | f · p | 111.2 | No | No (119) |
| B | This Invention | f · p | 129.9 | T · B | 105.5 | Yes | Yes (270) |
| B | This Invention | f · p | 134.0 | T · M | 119.2 | Yes | Yes (265) |
| B | This Invention | f · p | 128.2 | T · BM | 113.3 | Yes | Yes (251) |
| C | Control | f · p | 127.2 | f · p | 117.5 | No | No (101) |
| C | This Invention | f · p | 124.6 | T · B | 112.0 | Yes | Yes (221) |
| D | Control | f · p | 128.8 | p | 91.7 | No | No (137) |
| D | This Invention | f · p | 128.7 | T · M | 92.0 | Yes | Yes (329) |

The symbols in Table II are defined below:

p: pearlite structure f.p: fine pearlite structure

T.B: tempered bainite structure

T.M: tempered martensite structure

T.BM: mixed bainite-martensite structure

Some of web metal structure contains less than 30% of pearlite structure.

It should be noted that the temperating temperature of the web is 650° C. As above described according to this invention, in a rail having fine pearlite structure of high strength and wear resistant property capability of preventing propagation of unstable destructive crack from the head to the web and unstable rupture propagation in the horizontal direction through the web is imparted to the web so as to prevent breakage or large fracture of the rail.

What is claimed is:

1. A wear resistant rail comprising a head and a foot interjoined by a web, said rail consisting essentially of 0.50 to 0.85 wt.% of C, 0.10 to 1.0 wt.% of Si, 0.50 to 1.50 wt.% of Mn. less than 0.035 wt.% of P, less than 0.035 wt.% of S, less than 0.050 Wt.% of Al, and the balance iron and inevitable impurities, the web of said rail having a high toughness tempered bainite structure, and the head of said rail having a high strength fine pearlite structure, and the foot of said rail having a structure selected from the group consisting of (i) tempered bainite, (ii) tempered mixed structure of bainite and martensite and (iii) pearlite, said rail having the characteristic of preventing propagation of an unstable destructive crack.

2. The rail according to claim 1, further containing one or more of 0.05 to 1.50 wt.% of Cr, 0.05 to 0.20 wt.% of Mo, 0.03 to 0.10 wt% of V, 0.10 to 1.00 wt.% of Ni, and 0.005 to 0.050 wt.% of Nb.

3. The rail according to claim 1, wherein said web has a high toughness tempered mixed structure of bainite and martensite.

4. The rail according to claim 3, further containing one or more of 0.05 to 1.50 wt.% of Cr, 0.05 to 0.20 wt.% of Mo, 0.03 to 0.010 wt.% of V, 0.10 to 1.00 wt.% of Ni, and 0.005 to 0.050 wt.% of Nb.

5. The rail according to claim 1, wherein said foot has a high toughness tempered bainite structure.

6. The rail according to claim 1, wherein said foot has a high toughness tempered mixed structure of bainite and martensite.

7. The rail according to claim 1, wherein said foot has a pearlite structure.

8. The rail according to claim 2, wherein said foot has a high toughness tempered bainite structure.

9. The rail according to claim 2, wherein said foot has a high toughness tempered mixed structure of bainite and martensite.

10. The rail according to claim 2, wherein said foot has a pearlite structure.

11. The rail according to claim 2, wherein said foot has a high toughness tempered bainite structure.

12. The rail according to claim 3, wherein said foot has a high toughness tempered mixed structure of bainite and martensite.

13. The rail according to claim 3, wherein said foot has a pearlite structure.

14. The rail according to claim 4, wherein said foot has a high toughness tempered bainite structure.

15. The rail according to claim 4, wherein said foot has a high toughness tempered mixed structure of bainite and martensite.

16. The rail according to claim 4, wherein said foot has a pearlite structure.

* * * * *

UNITED STATES PATENT AND TRADEMARK OFFICE

CERTIFICATE OF CORRECTION

PATENT NO. : 4,767,475

DATED : August 30, 1988

INVENTOR(S) : FUKUDA et al

It is certified that error appears in the above-identified patent and that said Letters Patent is hereby corrected as shown below:

Column 8, line 31 (Claim 4), change:

"0.03 to 0.010 wt.% of V" to

--0.03 to 0.10 wt.% of V--.

Column 8, line 47 (Claim 11), change:

"claim 2" to --claim 3--.

Signed and Sealed this

Ninth Day of June, 1992

*Attest:*

*Attesting Officer*

DOUGLAS B. COMER

*Acting Commissioner of Patents and Trademarks*